US007334823B2

(12) United States Patent
Courter et al.

(10) Patent No.: US 7,334,823 B2
(45) Date of Patent: Feb. 26, 2008

(54) MOTORIZED OVEN LOCK HAVING A RECIPROCATING LATCH

(75) Inventors: Harry Ivan Courter, Indianapolis, IN (US); Brian Anthony Lamantia, Noblesville, IN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 11/418,918

(22) Filed: May 5, 2006

(65) Prior Publication Data

US 2007/0262590 A1 Nov. 15, 2007

(51) Int. Cl.
*E05C 3/06* (2006.01)

(52) U.S. Cl. ..... 292/201; 292/DIG. 62; 292/DIG. 69; 126/197

(58) Field of Classification Search ..... 292/201, 292/DIG. 62, DIG. 69; 126/197, 201
See application file for complete search history.

(56) References Cited

U.S. PATENT DOCUMENTS 4,082,078 A * 4/1978 Thuleen et al. ..... 126/197
4,163,443 A * 8/1979 Peterson ..... 126/197
4,796,932 A * 1/1989 Tame ..... 292/112
5,012,794 A * 5/1991 Faurel ..... 126/197
5,029,910 A * 7/1991 Genbauffe et al. ..... 292/110
5,220,153 A 6/1993 Malone et al.
5,493,099 A 2/1996 McWilliams, III
6,079,756 A 6/2000 Phillips
6,302,098 B1 10/2001 Smith
6,315,336 B1 * 11/2001 Swartzell ..... 292/201
7,156,428 B2 * 1/2007 Smith ..... 292/201

* cited by examiner

*Primary Examiner*—Patricia Engle
*Assistant Examiner*—Kristina R Gluchowski
(74) *Attorney, Agent, or Firm*—Maginot, Moore & Beck

(57) ABSTRACT

A simplified oven door lock reduces the number of components subjected to fatigue from repeated tensile movement. The oven door lock includes a mounting plate, an actuator having an output shaft and the actuator being coupled to the mounting plate, a cam having a mounting hub at its center and an offset hub displaced from the mounting hub, the mounting hub of the cam being coupled to the output shaft actuator so the actuator rotates the cam with respect to the mounting plate, a lock pin extending upwardly at a first position from the mounting plate, an unlock pin extending upwardly at a second position from the mounting plate, a latch mounted to the offset hub of the cam so the latch extends between the lock pin and the unlock pin so that opposing sides of the latch plate slide against the lock pin and the unlock pin as the latch moves in response to the actuator rotating the cam.

17 Claims, 5 Drawing Sheets

MOTORIZED OVEN LOCK HAVING A RECIPROCATING LATCH

CROSS-REFERENCES

Cross-reference is made to co-pending U.S. patent application Ser. No. 10/730,296 filed Dec. 8, 2003 entitled Motorized Oven Lock for Sealing Oven Door by Steve W. Smock, Harry I. Courter, Greg Wright and Tracy J. Talley, and U.S. patent application Ser. No. 10/730,475 filed Dec. 8, 2003, entitled Motorized Oven Lock by Steve W. Smock, Harry I. Courter, Greg Wright and Tracy J. Talley. U.S. patent application Ser. Nos. 10/730,296 and 10/730,475 are both assigned to the same assignee as the present application and the disclosures of both applications are hereby incorporated by reference in their entirety.

TECHNICAL FIELD

The devices disclosed herein relate generally to door locks for self-cleaning ovens and more particularly to oven door locks that block a door latch in its latched position during a self-cleaning cycle.

BACKGROUND

A conventional gas or electric oven is subject to collecting deposits from whatever is placed in the oven to be cooked. Modern ovens are designed to self-clean upon demand by reducing these deposits to dust with high heat. This cleaning method is commonly known as pyrolytic cleaning. The high temperature used for pyrolytic cleaning poses a hazard if the oven door is opened during the cleaning cycle. To prevent this, an oven door lock is employed.

Many types of oven door locks have been provided that lock the oven door for a period sufficient to complete a pyrolytic cleaning cycle once initiated. Many of these door locks use electrical motors, electromechanical devices or manual manipulation of mechanisms to move a latch to a position in which the latch prevents the oven door from being opened during a self-cleaning cycle. Examples of such locks are disclosed in Phillips, U.S. Pat. No. 6,079,756; Thuleen et al., U.S. Pat. No. 4,082,078; McWilliams, III, U.S. Pat. No. 5,493,099; Smith, U.S. Pat. No. 6,302,098; Swartzell, U.S. Pat. No. 6,315,336; and Malone et al., U.S. Pat. No. 5,220,153.

The oven lock mechanisms in these and other known locks use complicated mechanical arrangements to move a latch member between a latched and an unlatched position. These mechanisms include springs and irregularly shaped guide slots to manipulate the latch movement between the latched and unlatched positions. The springs present issues of reliability as the spring metal material is subjected to repeated extensions and contractions over its life as well as temperature extremes. The irregular guide slots lead to variations during metal stamping of the plates that may make the latch operations differ from lock to lock. Quality control tolerances may need tightening to address these variations, but that response leads to an increased part rejection rate and added expense to the manufacturing process.

SUMMARY

A simplified oven lock mechanism has been developed to reduce the complexity of oven door locks, eliminate parts that may contribute to a reduction in long term reliability, while providing consistent control of the door latch. A simplified oven door lock reduces the number of components subjected to fatigue from repeated tensile movement. The oven door lock includes a mounting plate, an actuator having an output shaft and the actuator being coupled to the mounting plate, a cam having a mounting hub at its center and an offset hub displaced from the mounting hub, the mounting hub of the cam being coupled to the output shaft actuator so the actuator rotates the cam with respect to the mounting plate, a lock pin extending upwardly at a first position from the mounting plate, an unlock pin extending upwardly at a second position from the mounting plate, a latch mounted to the offset hub of the cam so the latch extends between the lock pin and the unlock pin so that opposing sides of the latch plate slide against the lock pin and the unlock pin as the latch moves in response to the actuator rotating the cam.

Additional features and advantages of the disclosed oven lock are apparent to those skilled in the art upon consideration of the following detailed description of preferred embodiments exemplifying the best mode of implementing a motorized oven lock as presently perceived.

BRIEF DESCRIPTION OF THE DRAWINGS

The illustrative devices will be described hereinafter with reference to the attached drawings which are given as non-limiting examples only, in which.

DETAILED DESCRIPTION

The oven door lock mechanism 30 illustrated and described herein enables the latch mechanism 30 to move a latch 36 to a position that locks the oven door 12 in response to a user selecting the self-cleaning cycle for the oven. Such a position is referred to herein as a latched position. The disclosed mechanism 30 facilitates movement of the latch 36 between the latched and unlatched positions without requiring springs or guide slots.

Figure 1:
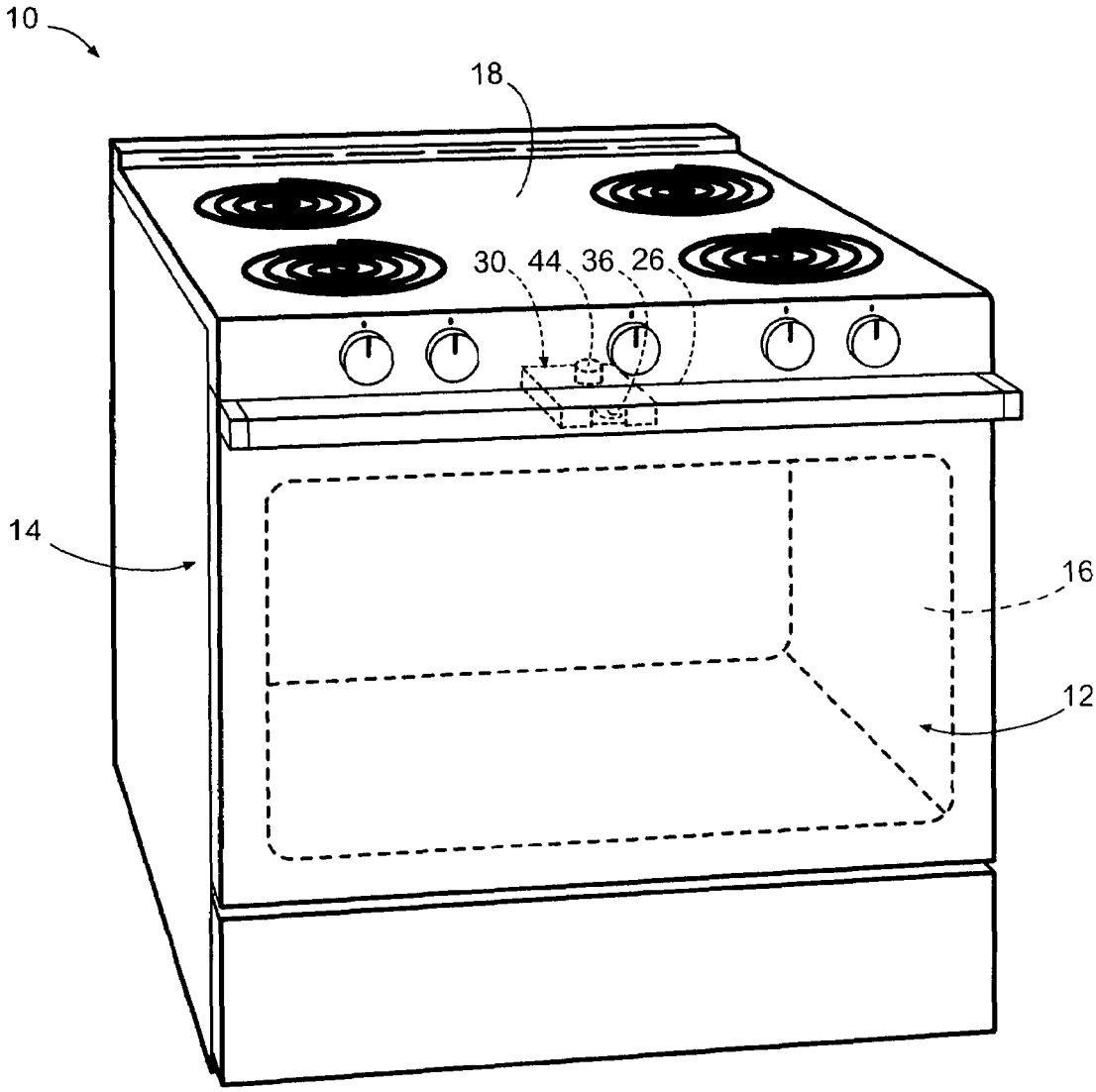
FIG. 1 is a perspective view of a self-cleaning oven with the oven door closed and the oven lock mechanism, which is shown in phantom lines, mounted at the front of the oven frame above the cooking chamber and below the cook top.

As shown in FIG. 1, for example, the illustrated embodiment of the oven lock mechanism 30 is configured for mounting in a self cleaning oven 10. The oven 10 includes a door 12 hinged at its bottom to a frame 14. The frame 14 of the oven 10 is disposed about an oven chamber 16. A cook top 18 is coupled to the frame and disposed above the oven chamber 16. The door 12 closes at an interface formed by an inner face of the door 12 and an abutment surface of the oven frame 14. The inner face of oven door 12 may be provided with a seal for engaging the abutment surface of the frame 14 to help seal oven chamber 16. Those skilled in the art will recognize that alternatively, the abutment surface of the frame 14 may be provided with a seal for engaging the inner face of the oven door 12. The disclosed embodiment of the oven door lock mechanism 30 is mounted at the top 26 of the frame 14 of the oven 10 just under the cook top 18.

Figure 2:
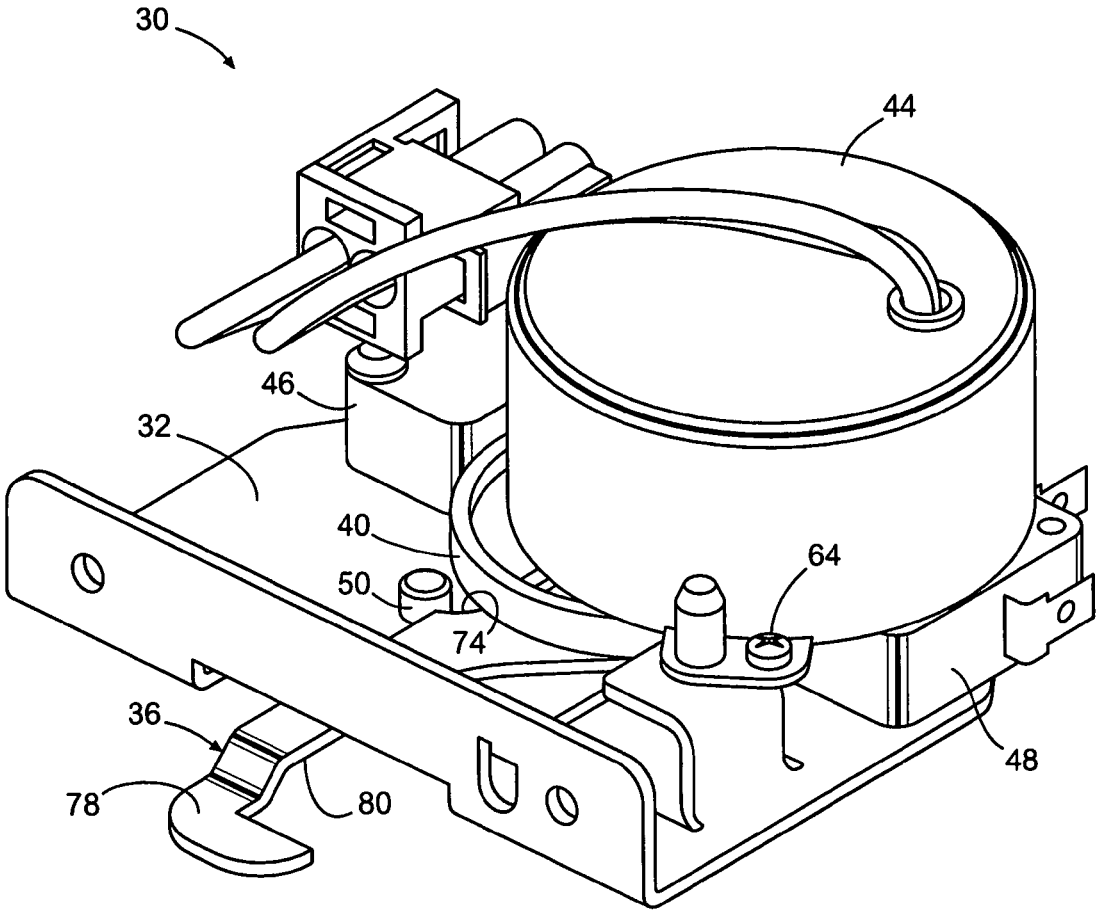
FIG. 2 is a perspective view of the oven lock mechanism shown in FIG. 1.

As shown in FIG. 2, for example, the illustrated oven lock mechanism 30 includes a mounting plate 32, a latch 36, a cam 40, a motor 44, two cam-actuated snap switches 46 and 48, a lock guide pin 50, and an unlock pin 54. In more detail, the mounting plate 32 may be a stamped or extruded metal piece made of, for example, G30 galvanized steel. The plate 32 provides a mounting surface for the components of the oven lock mechanism 30. An upturned flange 58 is formed with a latch opening 60 through which the latch 36 extends for its latching and unlatching functions. The latch 36, the cam 40, the motor 44, switch 48, and pins 50 and 54 are mounted on one side of mounting plate 32 in the embodiment shown in FIG. 2, although the motor 44 may be mounted on the other side of the plate. Snap action switches 46 and 48 may be mounted to plate 32 using known methods, such as screws, for example.

Screws 64, for example, may also be used to mount the motor 44 to the mounting brackets 56 that extend upwardly from the plate 32, as shown in FIG. 2. An output shaft of the motor 44 is eccentrically located with respect to the center of the motor and extends downwardly towards the plate 32. The motor may be, for example, a synchronous induction AC high torque Oven Door Lock class "F" motor. Motor 44 may operate at 3 RPM in response to a 120 VAC, 60 Hz signal, although other speeds and operating voltages may be used.

With continued reference to FIG. 2, lock guide pin 50 and the unlock pin 54 are protrusions that extend upwardly from the plate 32. The pins may be mounted to the plate 32 with screws, for example, so they may be selectively mounted to the plate or they may be fixedly mounted to the plate by welding, staking, soldering, or the like. While the pins 50 and 54 are shown as being cylindrical, other shapes may be used to guide the movement of the latch 36 as it is urged by the rotation of the cam 40. Pins 50 and 54 are positioned so they are on opposing sides of the latch 36 and are staggered with respect to one another. That is, a line drawn through the center of the short axis of one pin to the center of the short axis of the other pin is not perpendicular to longitudinal axis of the latch 36 when the latch is in the latched position. In some embodiments, the cross-section of the unlock pin 54 is larger than the cross-section of the lock guide pin 50, as shown in FIG. 2. These differing dimensions facilitate the coordinated movement of the latch 36, as configured in the figure, to the latched and unlatched positions, although other dimensions and latch arm configurations may be used. The pins 50, 54 and the latch 36 are preferably made from nickel-plated steel to improve their durability to wear from any engagement that may occur during the movement of the latch 36.

Figure 3:
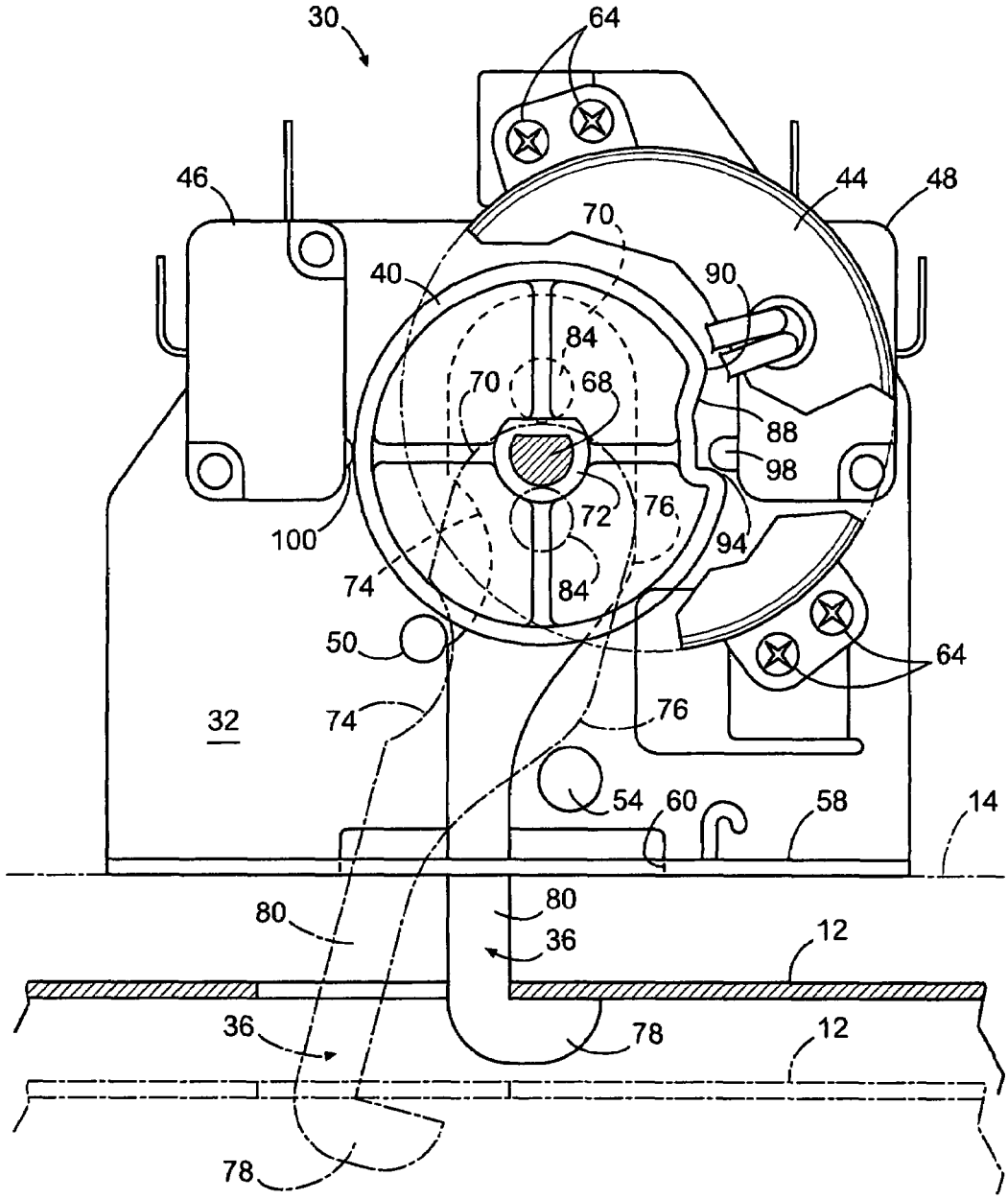
FIG. 3 is a top plan view of the oven lock mechanism shown in FIG. 1 with the latch shown in the locking position and phantom lines showing the latch in the unlocked position.

The cam, shown in FIG. 3, is primarily circular in shape with a mounting collar 72 located at its center. The mounting collar 72 typically has a D-shaped opening to mount to the D-shaped output shaft 68 of a typical oven door lock motor, although other shapes may be used for the motor output shaft 68 and the cam mounting collar 72. The cam is preferably formed from a plastic material, such as glass-filled nylon, although other materials may be used. On the side opposite the motor 44, an offset hub 84 is provided on the cam 40. The offset hub is eccentrically located on the cam 40 to rotationally displace the latch 36 as the cam is rotated by the motor 44.

The top view of the mechanism 30, shown in FIG. 3, demonstrates the position of the latch 36 at the latched (solid lines) and the unlatched (dashed lines) positions. The lock pin 50 and the unlock pin 54 are positioned on the plate so they are not diametrically opposed to one another across the latch 36. The unlock pin 54 is positioned with respect to the two positions of the offset hub 84 shown in the figure so that the rounded curve of the latch 36 is proximate the unlock pin 54 when the latch 36 is at the fully unlatched position. The unlock pin 54 helps hold the latch 36 in the fully unlatched position as any force directed against the latch 36 to move it to the latch position causes the rounded curve to engage the unlock pin 54, which blocks its further movement. The lock pin 50 is positioned with respect to the offset hub so that it encounters the rearward portion of the curve in the latch 36 as it begins to move from the unlatched to the latched position. This interaction positively moves the latch quickly to the straight position for latch pull-in so the reach of the latch 36 is maximized for engaging the oven door 12. This interaction enables the oven lock mechanism 30 to be used effectively with the tolerances for the gaps typically encountered between an unlatched oven door 12 and its frame 14. Also, at the fully latched condition, the lock pin 50 blocks movement of the front of the lock aperture 74 if a force is applied to the latch 36 to unlatch it from the door 12.

With further reference to FIG. 3, the mounting plate 32 has snap action switches 46 and 48 mounted to the plate. The rounded mounting end 70 of the latch 36 is mounted about the offset hub 84. The mounting collar 72 of the cam 40 is mounted about the output shaft of the motor 44 and the motor 44 is mounted to the mounting brackets extending from the plate 32. In this configuration, the cam 40 is positioned between the motor 44 and the latch 36 and the latch 36 is positioned between the cam 40 and the mounting plate 32.

The motor 44 and the cam 40 are located so that the perimeter of the cam 40 selectively interacts with the actuators of the snap action switches 46 and 48. Specifically, the perimeter of the cam 40 includes a switch interface 88 (FIG. 3). The interface has a slope 90 at one end and a drop-off 94 at the other end. The drop-off 94 enables spring-biased switch actuator 98 to extend fully from switch 48. When the cam rotates in the clockwise direction, as viewed in FIG. 3, the slope 90 urges the actuator against its spring bias so the actuator is depressed into the switch 48. The perimeter of the cam 40 continues to hold the actuator 98 in the depressed state until the drop-off 94 passes by the actuator 98 so it fully extends. The switch 48 is either a normally open or normally closed switch with the actuator 98 in the extended position. The state of the switch changes in response to the switch being depressed. Likewise, the switch 46 is a normally open or a normally closed switch with its actuator 100 in the extended position. When the actuator 100 is depressed, as shown in FIG. 3, the switch changes state. The states of the switches 46 and 48 may be monitored by a controller for the oven to determine when to couple and de-couple motor 44 to power.

In one embodiment, the latch 36 has the shape depicted in FIG. 3. The latch 36 in that figure has a rounded mounting end 70 that leads into two parallel sides. The side facing the lock guide pin 50 includes a lock aperture 74 that is illustrated as being roughly circular, although other shapes are possible. This side of the latch continues into a straight line that terminates into the outside edge of the hook 78. The side of the latch 36 that faces the unlock pin 54 curves inwardly to form neck 80 of the hook 78. The rounded corner where the straight side transitions to a curve to form a neck is an unlock detent 76. The mounting of the latch 36 to the offset hub 84 of the cam 40 and the placement of the pins 50 and 54 enables the latching and unlatching of the oven lock to occur with reciprocating motion of the latch 36.

In more detail, the lock mechanism 30 is installed in an oven so the mechanism is below the countertop and above the oven chamber. The lock mechanism is centered so the latch 36 extends through the opening 60 and can selectively engage with and disengage from the oven door. With the latch in the open position, shown with dashed lines in FIG. 3, the oven door opens and closes for normal use. In this position, the interface 88 is proximate the actuator 100 so the actuator 100 is fully extended. Also, the offset hub of the cam 40 is at the six o'clock position with respect to its center. In response to the self-cleaning cycle being selected, an electrical circuit for powering the motor is closed so the motor 44 begins to rotate in the clockwise direction as shown in FIG. 3. Alternatively, selection of the self-cleaning cycle may change the state of a switch that is coupled to an oven controller so the controller closes a circuit and powers the motor. As the cam rotates, the slope 90 depresses the actuator 100 so the switch 46 changes state. This change in state indicates the cam is rotating.

As the cam continues to rotate, it carries the latch 36 with it. As the latch 36 rotates, the lock aperture 74 of the latch 36 almost immediately encounters the lock guide pin 50. This interaction quickly uprights the latch 36 so it is perpendicular to the opening 60 and is at its maximum extension for lock pull-in. This interaction and extension occurs within the first 30 degrees of the cam rotation. As the cam continues to rotate towards the 12 o'clock position, the mounting end 70 of the latch 36 is pulled away from the oven door. The lock guide pin 50 remains in contact with the curved edge of the aperture 74 until the juncture of the aperture 74 and neck 80 is proximate the pin 50. During this movement, the hook 78 of the latch 36 engages the oven door and pulls the door towards the oven frame. The pull-in motion continues until the offset hub reaches the 12 o'clock position.

As shown in FIG. 3, the interface 88 is proximate the actuator 98 when the offset hub is at the 12 o'clock position and the actuator 98 fully extends. Upon extension, the state of the switch 48 changes to indicate the cam has rotated from the 6 o'clock position to the 12 o'clock position. In response to this state change, the electrical circuit powering the motor 44 is opened and the motor is decoupled from power so the cam stops rotation and the oven remains locked. Alternatively, the state change in the switch may be detected by an oven controller that decouples the motor from electrical power.

Upon completion of the self-cleaning cycle, the electrical circuit for powering the motor is closed so the motor 44 begins to rotate in the clockwise direction again. Alternatively, deactivation of the self-cleaning cycle may change the state of a switch that is coupled to an oven controller so the controller closes the circuit and powers the motor so it begins rotating in the clockwise direction. As the cam rotates in the clockwise direction, the slope 90 depresses the actuator 98 to indicate the cam has begun rotation. As the offset hub of the cam moves clockwise from the 12 o'clock position, the mounting end 70 of the latch 36 moves the latch 36 forward. The lock aperture 74 acts as a clearance with respect to lock pin 50 to facilitate the unlatching motion. As the cam rotation continues, the movement of the latch 36 causes the unlock detent 76 to engage the unlock pin 54 to rotate the latch 36 so that the neck 80 is stopped by the outside edge of the opening 60. In this position, the hook 78 is fully released from engagement with the oven door. After the cam has completed its 180 degree rotation, the switch interface 88 causes the actuator 100 to extend and the motor 44 is decoupled from power so the cam rotation stops. Once again, the user of the oven is able to open and close the door freely. The latch 36 remains in the unlatched position because any force pushing the latch 36 away from the outside edge of the opening 60 causes the unlock detent 76 to be blocked by the unlock pin 54.

Figure 4:
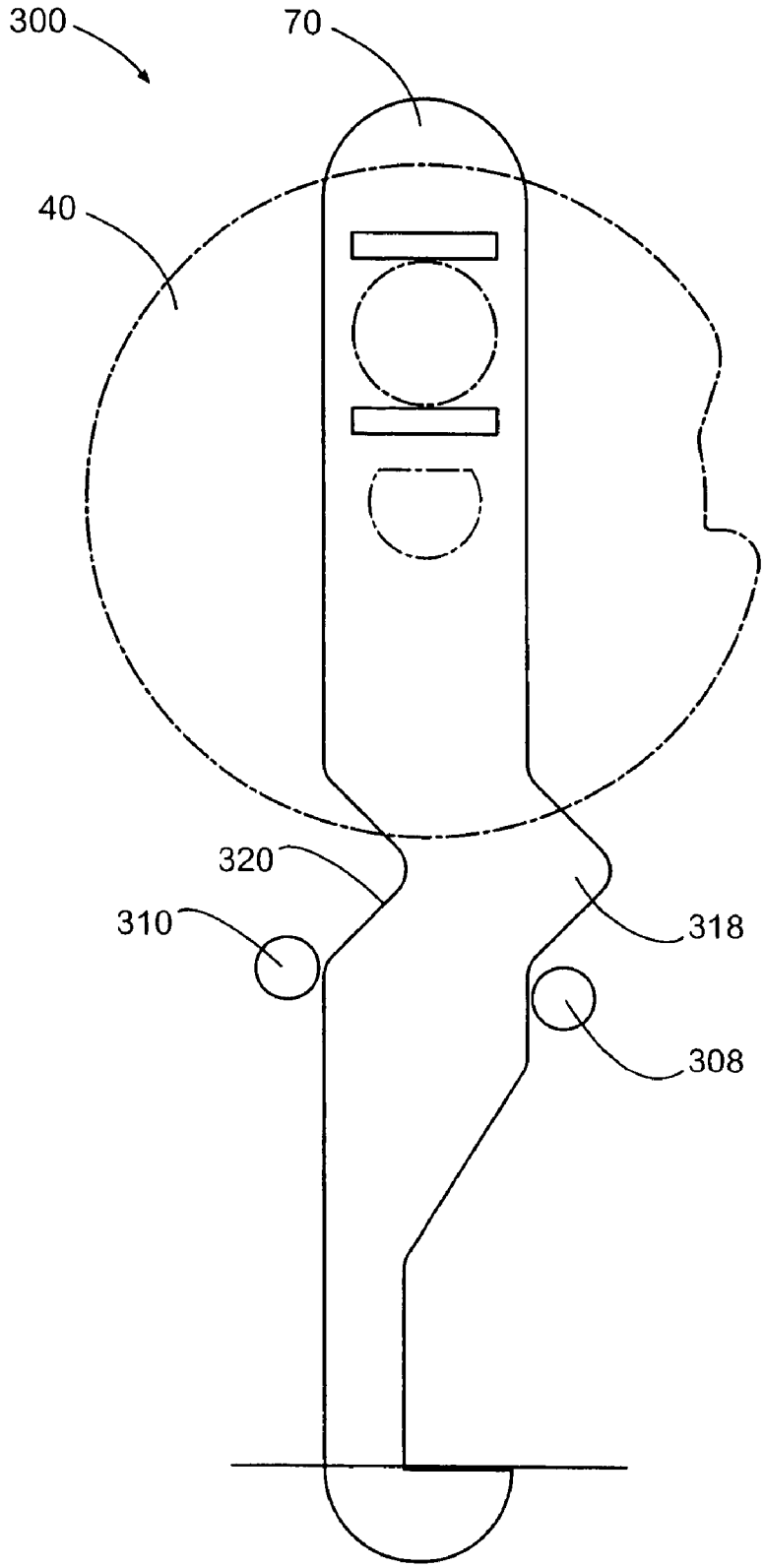
FIG. 4 is a top plan view similar to FIG. 3 showing an alternative embodiment of a latch and pin arrangement for the oven lock mechanism shown in FIG. 2 and FIG. 3.

In another embodiment, a latch 300, shown in FIG. 4, is used with the unlock pin 308 and lock pin 310. In this embodiment, the latch 300 is coupled to the offset hub of the cam 40 with a cradle and pin configuration. The pins 308 and 310 are staggered as explained above, but they are positioned so they are tangential to the parallel sides of the latch 300 when the latch 300 is perpendicular to the oven door. The pins 308 and 310 also have cross-sectional areas that are approximately equal to one another. The latch 300 includes a lock aperture 318 and an unlock aperture 320. The unlock detent 318 and the lock aperture 320 parallel one another and are positioned on the sides of the latch 300 at approximately the same distance from the mounting end 70 of the latch 300. In the embodiment shown in FIG. 4, the unlock detent is a protuberance that extends from the latch 300 and the lock aperture is a hollow in the opposing side of the latch 300, although other shapes and configurations may be used.

Figures 5A, 5B, 5C, 5D, 5E:
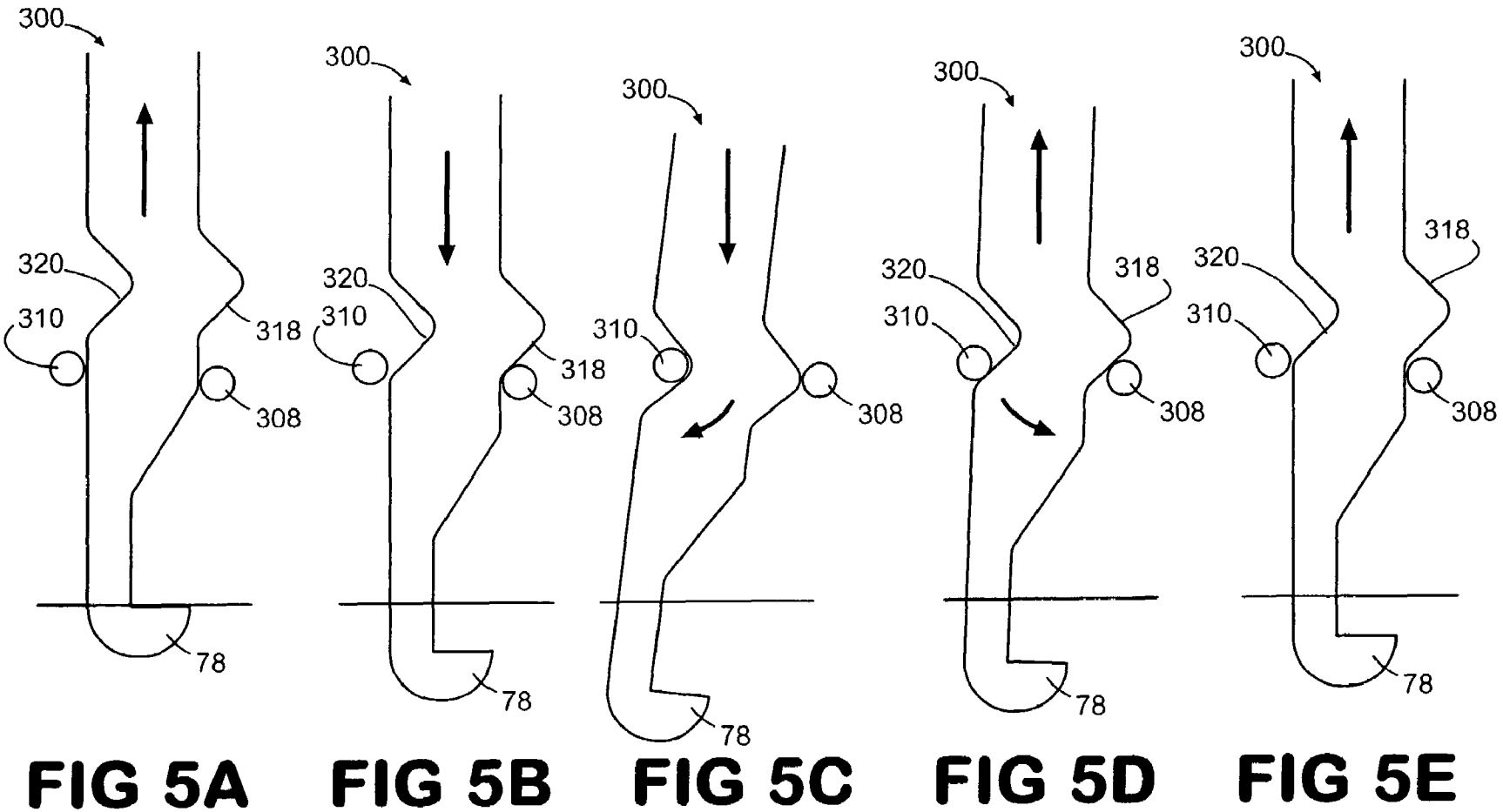
FIG. 5A, 5B, 5C, 5D, and 5E depict the interaction of the latch shown in FIG. 4 with the pin arrangement to latch and unlatch the door of an oven.

The action of the latch 300 is now described with reference to FIGS. 5A through 5E. At the pulled-in and locked position (FIG. 5A), the pins 308 and 310 are adjacent the parallel sides of the latch 300 and are forward of the unlock detent 318 and the lock aperture 320. In response to the motor commencing its rotation, the latch 300 begins to move forward to a position where the unlock pin 308 begins to interact with the unlock detent 318 (FIG. 5B). This interaction urges the latch 300 towards the lock pin 310. This urging continues until the lock pin engages the lowest point in the lock aperture 320 and the unlock pin 308 is at the top of the unlock detent 318 (FIG. 5C). At this position, the latch is fully open and the edge of the opening 60 stops the movement of the latch 36. Also, the cam interface 88 interacts with the actuators of the snap action switches to indicate the position has been reached and the motor stops rotating.

Upon selection of a self-cleaning cycle, the motor and cam begin to rotate so the latch 300 is pulled away from the oven door. As the latch 300 is pulled from the door, the lock pin 310 begins to interact with the lock aperture 320 to turn the latch 300 so it is perpendicular to the door (FIG. 5D). As the latch continues to be pulled rearward by the rotation of the cam, the hook 78 engages the door and pulls it closed and latched (FIG. 5E). As the cam rotates past the actuator of the snap switch, as described above, power is decoupled from the motor and the cam rotation stops so the door remains locked until the self-cleaning cycle is complete.

Although the oven door lock has been described in detail with reference to a certain illustrative embodiments, variations and modifications exist within the scope and spirit of the oven door lock as described and defined in the following claims.

What is claimed is:

1. An oven door lock mechanism for use with an oven having a door and a frame configured so that the door is adjacent the frame when the door is closed, the lock mechanism comprising:

a mounting plate;

an actuator having an output shaft and the actuator being coupled to the mounting plate;

a cam having a mounting collar at its center and an offset hub displaced from the mounting collar, the mounting collar of the cam being coupled to the output shaft of the actuator so the actuator rotates the cam with respect to the mounting plate;

a lock pin extending upwardly at a first position from the mounting plate;

an unlock pin extending upwardly at a second position from the mounting plate; and a latch having a hook at one end and mounted to the offset hub of the cam at an opposite end, the latch having two parallel sides extending between the ends and positioned between the lock pin and the unlock pin so that lock pin acts directly on one side of the latch and the unlock pin acts directly on another side of the latch to guide the latch as the latch moves between locked and unlocked positions in response to the actuator rotating the cam.

2. The mechanism of claim 1, the cam rotates approximately 180 degrees in one rotational direction to move the latch to a locking position and the cam rotates approximately an additional 180 degrees in the same rotational direction to move the latch to an unlocking position.

3. The mechanism of claim 1, the first position on the mounting plate from which the lock pin extends is offset from the second position on the mounting plate from which the unlock pin extends.

4. The mechanism of claim 3, the latch further comprising:

an unlock detent on the side of the latch on which the unlock pin acts; and a lock aperture on the side of the latch on which the lock pin acts.

5. The mechanism of claim 4, the unlock detent being a protuberance on the side of the latch on which the unlock pin acts.

6. The mechanism of claim 4, the lock aperture being a hollow on the side of the latch on which the lock pin acts.

7. The mechanism of claim 5, the lock aperture being a hollow on the side of the latch on which the lock pin acts, the hollow having a shape that corresponds to the protuberance on the side of the latch on which the unlock pin acts.

8. The mechanism of claim 1, the latch having two parallel sides with an unlock detent on one of the parallel sides of the latch to engage the unlock pin during movement of the latch and a lock aperture in the other parallel side of the latch to engage the lock pin.

9. An oven door lock mechanism for use with an oven having a door and a frame configured so that the door is adjacent the frame when the door is closed, the lock mechanism comprising:

a mounting plate;

an actuator having an output shaft and the actuator being coupled to the mounting plate;

a cam having a mounting collar at its center and an offset hub displaced from the mounting collar, the mounting collar of the cam being coupled to the output shaft of the actuator so the actuator rotates the cam with respect to the mounting plate;

a lock pin extending upwardly at a first position from the mounting plate;

an unlock pin extending upwardly at a second position from the mounting plate; and a hooked latch having two longitudinal parallel sides with an unlock detent on one parallel side of the latch to engage the unlock pin during movement of the latch and a lock aperture in the other parallel side of the latch to engage the lock pin during movement of the latch, the lock aperture and the unlock detent being parallel to one another, the latch being mounted to the offset hub of the cam to position the latch between the lock pin and the unlock pin so the lock pin and the unlock pin act on opposing parallel sides of the latch as the latch moves between locked and unlocked positions in response to the actuator rotating the cam.

10. The mechanism of claim 9 wherein the unlock detent is a protuberance extending from the parallel side of the latch on which the unlock pin acts;

the lock aperture is a hollow in the parallel side of the latch on which the lock pin acts; and the protuberance and the hollow have a shape that corresponds to one another.

11. An oven door lock mechanism for use with an oven having a door and a frame configured so that the door is adjacent the frame when the door is closed, the lock mechanism comprising:

a mounting plate;

an actuator having an output shaft and the actuator being coupled to the mounting plate;

a cam having a mounting collar at its center and an offset hub displaced from the mounting collar, the mounting collar of the cam being coupled to the output shaft of the actuator so the actuator rotates the cam with respect to the mounting plate;

a lock pin extending upwardly at a first position from the mounting plate;

an unlock pin extending upwardly at a second position from the mounting plate, the first position on the mounting plate from which the lock pin extends being offset from the second position on the mounting plate from which the unlock pin extends; and a latch having a hook at one end and mounted to the offset hub of the cam at an opposite end, the latch having two parallel sides extending between the ends and positioned between the lock pin and the unlock pin so that lock pin and the unlock pin act directly on opposite sides of the latch to guide the latch as the latch moves between locked and unlocked positions between the lock pin and the unlock pin in response to the actuator rotating the cam.

12. The lock mechanism of claim 11 wherein the cam rotates in only one direction.

13. The lock mechanism of claim 11, the latch further comprising:

a lock aperture on the side of the latch on which the lock pin acts;

an unlock detent on the side of the latch on which the unlock pin acts; and the lock pin interacts with the lock aperture to upright the latch within approximately 30 degrees of the cam's rotation to put the latch in a latching position.

14. The lock mechanism of claim 12 wherein the lock pin interacts with the lock aperture to keep the latch in the latched position.

15. The lock mechanism of claim 11 wherein the unlock pin blocks the latch from moving towards a unlatched position.

16. The lock mechanism of claim 11, the mounting bracket further comprising:

a flange at one edge of the mounting plate; and the flange includes an opening through which a portion of the latch passes.

17. The lock mechanism of claim 16, the latch further comprising:

a hook on the portion of the latch passing through the opening in the flange; and an edge of the hook being stopped in the unlatching movement by an edge of the flange in the opening.

* * * * *